US005832358A

United States Patent [19]

Sampath et al.

[11] Patent Number: 5,832,358

[45] Date of Patent: Nov. 3, 1998

[54] UNSCHEDULED SET EJECTION METHOD IN A FINISHER

[75] Inventors: Barbara A. Sampath, Geneseo; Richard J. Milillo, Fairport; Edward W. Mallow, Jr., Henrietta, all of N.Y.

[73] Assignee: Xerox Corporation, Stamford, Conn.

[21] Appl. No.: 922,073

[22] Filed: Sep. 2, 1997

[51] Int. Cl.[6] ..... G03G 15/00

[52] U.S. Cl. ..... 399/405; 399/16; 399/407; 399/410

[58] Field of Search ..... 399/9, 16, 18, 399/20, 21, 19, 43, 45, 81, 361, 381, 397, 403, 405, 407, 408, 410

[56] References Cited

U.S. PATENT DOCUMENTS

| | | | |
|---|---|---|---|
| 3,467,371 | 9/1969 | Britt et al. | 270/58 |
| 4,134,672 | 1/1979 | Burlew et al. | 399/410 |
| 4,603,971 | 8/1986 | Kukucka et al. . | |
| 4,965,629 | 10/1990 | Hiroi et al. | 399/410 X |
| 5,073,803 | 12/1991 | Kato et al. | 399/410 X |
| 5,140,380 | 8/1992 | Nakamura et al. | 399/408 |
| 5,424,821 | 6/1995 | Sampath . | |

*Primary Examiner*—Sandra Brase
*Attorney, Agent, or Firm*—Ronald F. Chapuran

[57] ABSTRACT

A method of ejecting copy sheets from the compiler in a printing apparatus that includes a processing section for transferring a developed image onto a copy sheet and a finishing section with a compiler and a stapler for receiving plural copy sheets to generate a print set. In particular, the level of copy sheets in a compiler tray is sensed, a tag in non-volatile memory indicating a number of allowable extra copy sheets in the compiler is monitored, and a capacity count for sheets to be stapled is referenced. In response, a set of copy sheets may be ejected from the compiler in an unscheduled manner as a function of the level of copy sheets in the compiler tray, the tag in non-volatile memory, and the capacity count for sheets to be stapled. This enables the finisher to complete a set that might have been prematurely ejected or enables the finisher to eject a set before reaching a jam condition.

18 Claims, 3 Drawing Sheets

UNSCHEDULED SET EJECTION METHOD IN A FINISHER

BACKGROUND OF THE INVENTION

This invention relates to electrostatographic printing machines, and, more particularly, to an electrostatographic printing system having a finishing station.

The electrostatographic copying process is well known and is commonly used for light lens copying of an original document. Analogous processes also exist in other electrostatographic printing applications such as, for example, ionographic printing and reproduction, where charge is deposited on a charge retentive surface in response to electronically generated or stored images. The primary output product for a typical electrostatographic printing system is a printed copy substrate such as a sheet of paper bearing printed information in a specified format. Quite often, customer requirements necessitate that this output product be configured in various specialized arrangements or in print sets ranging from stacks of collated loose printed sheets to tabulated and bound booklets.

The stacks of collated, loose printed sheets are often permanently affixed together in sets. For example, the collated, loose printed sheets may be stapled together or bound together by means of glue or other adhesive. The binding or stapling of the sets of printed sheets typically and preferably occurs during the operation of the printing machine. Applying adhesive or stapling the sheets and transferring the set of sheets to a position where the stapling and/or the gluing can occur, must be done during the printing cycle or in "real" time when utilizing the printing machine. The added time to staple or bind may be accommodated by stopping the printing of the machine during the stapling and binding process. Such interruption of the machine during stapling and binding greatly reduces the capacity of high speed printing machines.

Lost productivity may also result from jams in the finisher in attempting to staple or affix a set of sheets to thick for the affixing mechanism or prematurely ejecting an incomplete set. It is known in the prior art to be able to control the switching and timing in operating a finishing station in various modes as shown in U.S. Pat. No. 4,603,971, assigned to the same assignee as the present invention. It is also known to be able to monitor copy sheets of different characteristics along a copy sheet path and to make timing adjustments for the copy sheets in accordance with the determined characteristics, as disclosed in U.S. Pat. No. 5,424,821, also assigned to the same assignee as the present invention.

It is desirable to provide an electrostatographic copying system with a maximum throughput at the finishing station. It is also known as disclosed in pending, U.S. Ser. No. 08/719,269 (D/96238) to provide sheet feeding apparatus for feeding sheets through a processing station to a finishing station and exiting the finishing station at different transitional speeds.

A difficulty with prior art systems as mentioned above is that oftentimes elements in the finisher device, such as compiler trays and staplers and binders have limited capacity and to exceed the capacity is to risk a machine jam. However, setting capacity is not necessarily the answer since the capacity limits can be prone to error due to different characteristics of the paper such as thickness and weight. A set capacity limit, if set too low, might unnecessary reject sufficient copy sheets for a completed set or if not set low enough might accommodate a set of sheets creating a machine jam.

It would be desirable, therefore, to overcome these difficulties in the prior art and provide a flexible, intelligent finisher station that can monitor and adjust the accumulation of copy sheet sets in a compiler to maximize machine efficiency and throughput and yet not unduly risk machine malfunctions.

SUMMARY OF INVENTION

The present invention is a method of ejecting copy sheets from the compiler in a printing apparatus that includes a processing section for transferring a developed image onto a copy sheet and a finishing section with a compiler and a stapler for receiving plural copy sheets to generate a print set. In particular, the level of copy sheets in a compiler tray is sensed, a tag in non-volatile memory indicating a number of allowable extra copy sheets in the compiler is monitored, and a capacity count for sheets to be stapled is referenced. In response, a set of copy sheets may be ejected from the compiler in an unscheduled manner as a function of the level of copy sheets in the compiler tray, the tag in non-volatile memory, and the capacity count for sheets to be stapled. This enables the finisher to complete a set that might have been prematurely ejected or enables the finisher to eject a set before reaching a jam condition.

BRIEF DESCRIPTION OF THE DRAWINGS

For a general understanding of the present invention, as well as other aspects thereof, reference is made to the following description and drawings, in which like reference numerals are used to refer to like elements, and wherein.

While the present invention will be described with a reference to preferred embodiments thereof, it will be understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds.

DESCRIPTION OF EMBODIMENT

It will become apparent from the following discussion that set ejection method of the present invention is equally well suited for use in a wide variety of electrophotographic or electronic printing systems, as for example, ink jet, ionographic, laser based exposure systems, etc.

Figure 1:
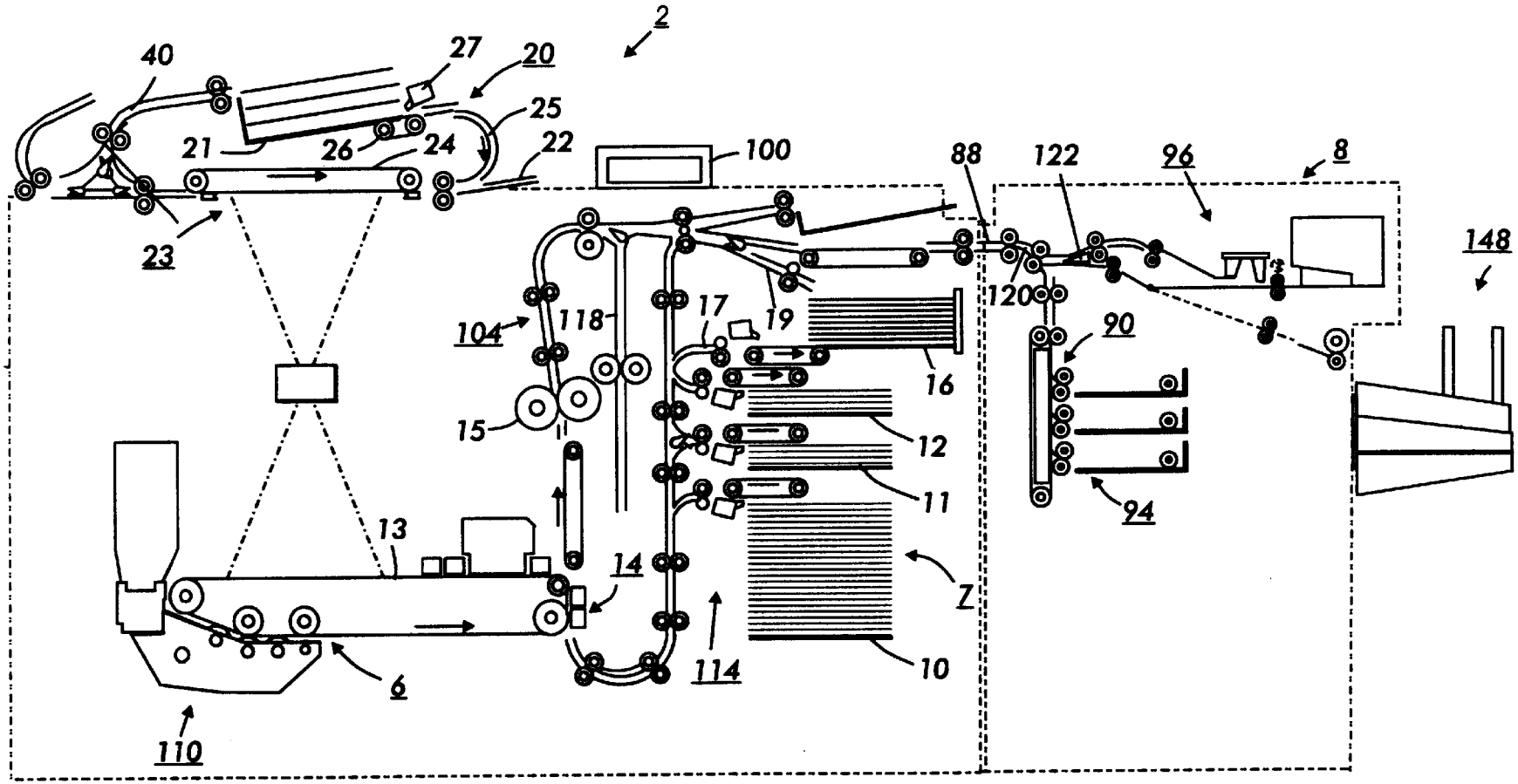
FIG. 1 is a schematic elevational view of a printing machine incorporating the unscheduled set ejection method according to the present invention.

In FIG. 1, there is shown, in schematic form, an exemplary electrophotographic copying system 2 for processing, printing and finishing print jobs in accordance with the teachings of the present invention. For purposes of explanation, the copying system 2 is divided into a xerographic processing or printing section 6, a sheet feeding section 7, and a finishing section 8. The exemplary electrophotographic copying system 2 of incorporates a recirculating document handler (RDH) 20 of a generally known type, which may be found, for example, in the well known Xerox Corporation model "1075 ", "5090" or "5100" duplicators.

Such electrostatographic printing systems are illustrated and described in detail in various patents cited above and otherwise, including U.S. Pat. No. 4,961,092, the principal operation of which may also be disclosed in various other xerographic or other printing machines.

A printing system of the type shown herein is preferably adapted to provide, in a known manner, duplex or simplex collated print sets from either duplex or simplex original documents circulated by a document handler. As is conventionally practiced, the entire document handler unit 20 may be pivotally mounted to the copier so as to be liftable by an operator for alternative manual document placement and copying. In this manner, the exemplary printing system or apparatus 2 is designed to receive input documents as manually positioned on an optically transparent platen or automatically positioned thereon via a document handler, such as a recirculating document handler (RDH) 20, via a document handler input tray 21 or a document feeder 22.

RDH 20 operates to automatically transport individual registered and spaced document sheets into an imaging station 23, platen operatively associated with the xerographic processing section 6. A platen transport system 24 is also provided, which may be incrementally driven via a non-slip or vacuum belt system controlled by a system controller 100 for stopping the document at a desired registration (copying) position in a manner taught by various references known in the art.

The RDH 20 has a conventional "racetrack" document loop path configuration, which preferably includes generally known inverting and non-inverting return recirculation paths for transporting original input documents back to the RDH loading and restacking tray 21. The RDH 20 may be a conventional dual input document handler, having an alternative semiautomatic document handling (SADH) side loading slot 22. Documents may be fed to the same imaging station 23 and transported by the same platen transport belt 24 from either the SADH input 22 at one side of the RDH 20, or from the regular RDH input, namely the loading or stacking tray 21, situated on top of the RDH unit. Input path 25 preferably includes a known "stack bottom" corrugated feeder-separator belt 26 and air knife 27 system including, document position sensors (not shown), and a set of turn baffles and feed rollers for inverting the incoming original documents prior to imaging.

Briefly, input documents are typically exposed to a light source on the platen imaging station 23, or fed across the platen without being exposed, after which the documents may be ejected by the platen transport system 24 into downstream or off-platen rollers and further transported past a gate or a series of gates and sensors. Depending on the position of these gates, the documents are either guided directly to a document output path and then to a catch tray, or, more commonly, the documents are deflected past an additional sensor, and into an RDH return path 40.

The entire stack of originals in the RDH tray 21 can be recirculated and copied to produce a plurality of collated copy sets. In addition, the document set or stack may be recirculated through the RDH any number of times in order to produce any desired number of collated duplex print sets, that is, collated sets of duplex copy sheets, in accordance with various instruction sets known as print jobs which can be programmed into a controller 100, to operator which will be described.

Since the copy or print operation and apparatus of the present invention is well known and taught in numerous patents and other published art, the system will not be described in detail herein. Briefly, blank or preprinted copy sheets are conventionally provided by sheet feeder section 7, whereby sheets are delivered from a high capacity feeder tray 10 or from auxiliary paper trays 11 or 12 for receiving a copier document image from photoreceptor 13 at transfer station 14. In addition, copy sheets can be stored and delivered to the xerographic processing section 6 via auxiliary paper trays 11 or 12 which may be provided in an independent or stand alone device coupled to the electrophotographic printing system 2. After a developed image is transferred to a copy sheet, an output copy sheet is delivered to a fuser 15, and further transported to finishing section 8 (if they are to be simplex copies), or, temporarily delivered to and stacked in a duplex buffer tray 16 if they are to be duplexed, for subsequent return (inverted) via path 17 for receiving a second side developed image in the same manner as the first side. This duplex tray 16 has a finite predetermined sheet capacity, depending on the particular copier design. The completed duplex copy is preferably transported to finishing section 8 via output path 88. An optionally operated copy path sheet inverter 19 is also provided.

Output path 88 is directly connected in a conventional manner to an optional bin sorter 90 as is generally known and as is disclosed in commonly assigned U.S. Pat. No. 3,467,371, incorporated in its entirety by reference herein. Bin sorter 90 includes a vertical bin array 94 which is conventionally gated (not shown) to deflect a selected sheet into a selected bin as the sheet is transported past the bin entrance. An optional gated overflow top stacking or purge tray may also be provided for each bin set.

The vertical bin array 94 may also be bypassed by actuation of a gate 122 for directing sheets serially onward to a subsequent finishing station illustrated at 96 which may include a stitcher mechanism for stapling print sets together and/or a thermal binder system for adhesively binding the print sets into books.

All document handler, xerographic imaging sheet feeding and finishing operations are preferably controlled by a generally conventional programmable controller 100. The controller 100 is additionally programmed with certain novel functions and graphic user interface features for the general operation of the electrostatographic printing system 2 and the dual path paper feeder of the present invention. The controller 100 preferably comprises a known programmable microprocessor system, as exemplified by the above cited and other extensive prior art (i.e., U.S. Pat. No. 4,475,156, and its references), for controlling the operation of all of the machine steps and processes described herein, including actuation of the document and copy sheet feeders and inverters, gates, etc. As further taught in the references, the controller 100 also conventionally provides a capability for storage and comparison of the numerical counts of the copy and document sheets, the number of documents fed and recirculated in a document or print set, the desired number of copy sets, and other functions which may be input into the machine by the operator through an input keyboard control or through a variety of customized graphic user interface screens. Control information and sheet path sensors (not shown) are utilized to control and keep track of the positions of the respective document and copy sheets as well as the operative components of the printing apparatus via their connection to the controller. The controller 100 may be conventionally connected to receive and act upon jam, timing, positional and other control signals from various sheet sensors in the document recirculation paths and the copy sheet paths. In addition, the controller 100 can preferably automatically actuate and regulate the positions of sheet path selection gates, including those gates associated with the dual path paper feeder, depending upon the mode of operation selected by the operator and the status of copying in that mode.

It shall be understood from the above description that multiple print jobs, once programmed, are scanned and printed and finished under the overall control of the machine controller 100. The controller 100 controls all the printer steps and functions as described herein, including imaging onto the photoreceptor, paper delivery, xerographic functions associated with developing and transferring the developed image onto the paper, and collation of sets and delivery of collated sets to the binder or stitcher, as well as to a stacking device. The printer controller 100 typically operates by initiating a sequencing schedule which is highly efficient in monitoring the status of a series of successive print jobs to be printed and finished in a consecutive fashion. This sequencing schedule may also utilize various algorithms embodied in printer software to introduce delays for optimizing particular operations.

The essence of the invention is to provide a method in finishing systems to avoid paper jams and overfilling/stuffing the compiler tray/station. This method determines whether to eject a partial set in real time or wait until a scheduled end of set/subset. During an early ejection of a set, this method also prevents the subsequent ejection of a single sheet, if so desired. In various finishing systems, early ejection may become necessary when there is a risk of overfilling the compiler tray (i.e., due to operator error on job input, too think and/or high curl/fluff paper, and/or sets that exceed the capacity of an in-line stapler/stitcher.

The overfilled condition may not be apparent from the programmed jobs, and the decision and execution for the method of set ejection must be made in real time triggered from input from a set height sensing device or system. One embodiment of the present invention is a software method to decide on the unscheduled ejection of a set once a compiling tray is sensed to be full. This invention can support various finishing compiling tray systems that have the capability of sensing when the tray has reached full capacity. Note that this invention does not include any specific method of stack height sensing since there are various ways of stack height sensing that can be used to sense a tray full condition.

Figure 2:
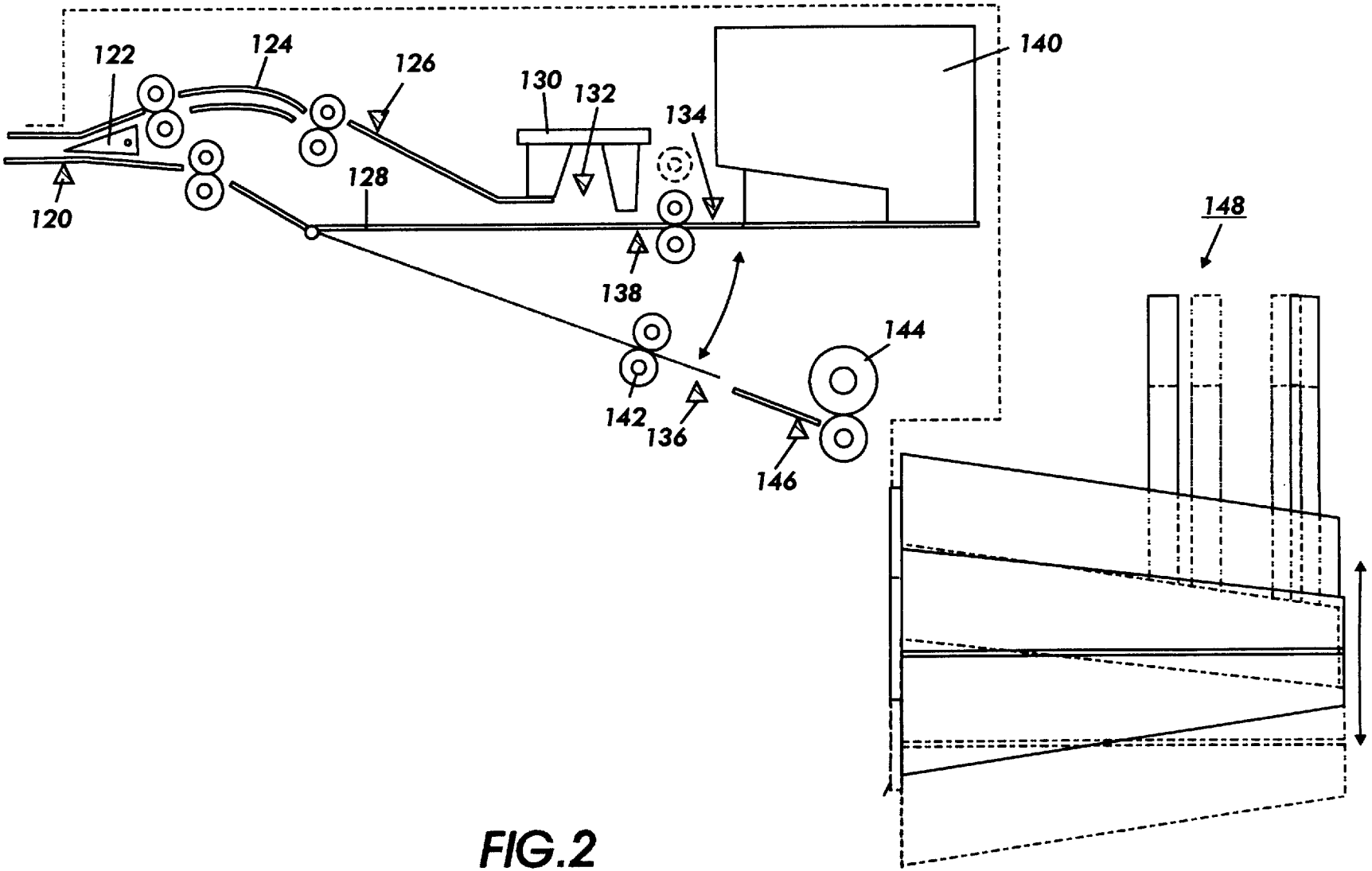
FIG. 2 is a more detailed illustration of the finishing station incorporating the unscheduled set ejection method according to the present invention.

Turning now to the specific example of the invention, as disclosed herein, and in particular as illustrated in FIG. 2. Upon deflection of a copy sheet by the gate 122 to the finisher station 96 after detection by sensor 120, a copy sheet is conveyed by the sheet transport illustrated at 124 to compiler tray 128. A swiper device 130 for registering and compiling copy sheets at the compiler tray 128 is periodically indexed upwardly in response to sensor 138 as the height of the copy sheet set in the compiler tray 128 increases. The swiper device 130 is elevated by a not shown motor driven rotational cam. The cam includes a sensor flag which rotates with the cam and trips an optical sensor illustrated at 132 when the swiper device has reached its upper most position, therefore indicating that the compiler tray 128 is full. Copy sheets exiting the copy sheet path 124 are monitored by compiler entrance sensor 126 to provide a count of copy sheets entering the finisher station.

Additional sensors, compile tray up sensor 134 and compile tray down sensor 136 provide signals regarding the extreme positions of the compiler tray 128. Stapler 140 or any other suitable binding device, fasten together a complete set of copy sheets as provided in the compiler tray 128 and the compiler tray is then suitably lowered for the completed set of copy sheets to be ejected by the eject rolls 142 to the output tray rolls 144 to be delivered to the vertically moving output tray assembly 148. Finisher exit jam switch 146 provides an indication of the positive movement of a copy sheet set to the tray assembly shown at 148.

Figure 3:
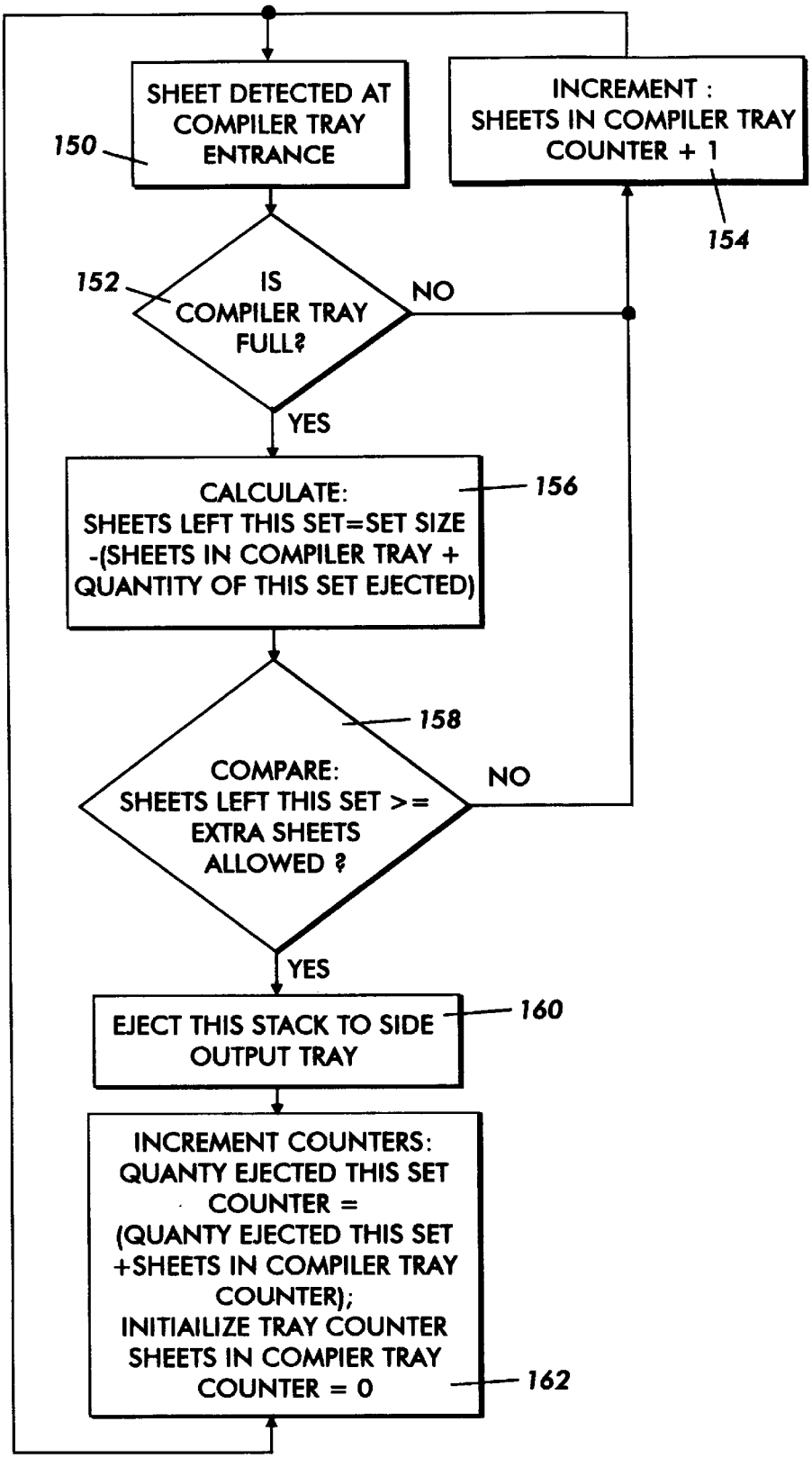
FIG. 3 is a flow chart illustrating the set ejection method according to the present invention.

With reference to FIG. 3, there is shown a flow chart of the unscheduled set ejection technique in accordance with the present invention. In particular, block 150 illustrates the detection of a copy sheet at the compiler tray entrance. Decision block 152 determines whether or not the compiler tray is full. If the compiler tray is not full, the next sheet is fed to the compiler tray and a suitable counter incremented to maintain the count shown in block 154. However, once the tray is detected full, a decision must be made whether or not to eject the set prematurely to a suitable catch tray or to continue filling the tray until the scheduled end of a set. The scheduled end of set would be a programmed complete set of copy sheets, a complete set being necessary before activating the stapler or other binding device.

For example, if there are only two sheets to be compiled for a complete set to be stapled, when the tray has been sensed full, a decision may be made to finish the set at that time without having to prematurely eject an incomplete set. The amount of sheets to allow after sensing a full tray, it should be noted, is a variable that can be set for system requirements. There is always a balance between allowing extra sheets into a compiler tray and risking a jam and the desire to not unduly curtail building a complete set before stapling or binding by ejecting a set prematurely under the apprehension of a jam. It should also be noted that the capacity of the binding operation or stapling operation must also be taken into account and could be an additional variable that would limit additional sheets into the compiler tray.

Before transferring to the stapler or binding operation, with reference to the flow chart, at block 156 there is a calculation of the sheets needed to complete a set. The number of sheets left in a set is a function of the set size less the sheets in the compiler tray plus any quantity that may already been prematurely ejected from the compiler tray. In block 158, a decision is made whether or not the number of sheets left for a given set is greater or equal to the extra sheets that can be allowed into the compiler tray. As mentioned above, the extra sheet that may be allowed in the compiler tray is an arbitrary number set in non-volatile memory depending upon various system hardware capabilities. If the determination is that the sheet left is not greater than or equal to extra sheets allowed, then an additional sheet can be entered in to the compiler tray as illustrated in block 154 and the counters appropriately incremented.

If the sheets left is greater than the extra sheets allowed, then as shown in block 160, it is necessary to eject this stack to a side or alternate output tray. Thus, the key to the invention is the ability to decide whether or not to eject a partial set from the compiler tray or to be able to continue to keep filling the tray to reach a full set for stapling or binding. This decision, of course, is necessitated by the recognition of a signal from a sensor at the compiler that the tray is full. This decision or determination is based upon several parameters such as anticipated set size, quantity of sheets in the set already ejected, quantity of sheets in the set in the compiler tray, and a non volatile memory allowable extra sheet indicator that is accessed the moment the compiler tray is sensed full.

Once a partial set has been ejected from the compiler to the side output tray as shown in block 160 it is necessary to increment the counters. Thus a quantity ejected this set counter equals the quantity ejected this set plus sheets in the compiler tray counter. Also it is necessary to initialize the tray counter sheets in the compiler tray to zero. Also as illustrated, any time, as shown in block 154, there is an increment to the counter of the sheets in the compiler tray, this count also is shown as providing an input to the tray counter in block 162.

It is, therefore, evident that there has been provided, in accordance with the present invention, an electrostatographic copying apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. In a printing apparatus, including a processing section for transferring a developed image onto a copy sheet and a finishing section with a compiler and a stapler for receiving plural copy sheets to generate a print set, a method of ejecting copy sheets from the compiler comprising the steps of:

sensing the level of copy sheets in the compiler tray, monitoring a tag in non-volatile memory indicating a number of allowable extra copy sheets in the compiler, referencing a capacity count for sheets to be stapled, and ejecting a set of copy sheets from the compiler as a function of the level of copy sheets in the compiler tray, the tag in non-volatile memory indicating a number of allowable extra copy sheets in the compiler, and the capacity count for sheets to be stapled.

2. The printing apparatus of claim 1, wherein the step of sensing the level of copy sheets in the compiler tray includes the step of sensing a full capacity level.

3. The printing apparatus of claim 1, wherein the tag in non-volatile memory indicating a number of allowable extra copy sheets in the compiler is a function of the characteristics of the copy sheets.

4. In a printing machine having a finisher tray for stacking copy sheets, a method of averting a jam comprising the steps of:

sensing the finisher tray to be near capacity, tracking the number of copy sheets remaining to be fed to the finisher tray for a complete set of copy sheets, monitoring a value stored in memory representing an approximate capacity remaining in the finisher tray, and responsive to tracking the number of copy sheets remaining to be fed to the finisher tray and monitoring the value stored in memory making a determination regarding a potential capacity of the finisher tray.

5. The method of claim 4 including the step of determining that the finisher tray cannot accommodate the number of copy sheets remaining to be fed.

6. The method of claim 5 including the steps of ejecting the partial set of copy sheets in the finisher tray to an output tray and feeding the remaining copy sheets to the finisher tray and ejecting to the output tray.

7. The method of claim 6 including the step of displaying an operator warning.

8. The method of claim 4 including the step of determining that the finisher tray can accommodate the number of copy sheets remaining to be fed.

9. The method of claim 4 wherein the printing machine includes a stapler and including the step of determining the set capacity of the stapler.

10. The method of claim 9 including the step of determining that the stapler cannot accommodate the number of copy sheets remaining to be fed to the compiler in order to properly staple the set of copy sheets in the compiler.

11. The method of claim 10 including the step of ejecting copy sheets in the compiler tray to an output tray bypassing the stapler.

12. The method of claim 9 including the step of displaying an operator message that the job set capacity exceeds the capacity of the stapler.

13. In a printing machine having a compiler tray for stacking copy sheets, a method of averting a jam comprising the steps of:

sensing the compiler to be near capacity, tracking the number of copy sheets remaining to be fed to the compiler for a complete set of copy sheets, monitoring a value stored in memory representing an approximate capacity remaining in the compiler tray, and responsive to tracking the number of copy sheets remaining to be fed to the compiler and monitoring the value stored in memory making a determination that the compiler tray cannot accommodate the number of copy sheets remaining to be fed to the compiler.

14. The method of claim 13 including the steps of ejecting the partial set of copy sheets in the compiler tray to an output tray.

15. The method of claim 14 including the step of feeding the remaining copy sheets to the compiler.

16. The method of claim 15 including the step of ejecting the remaining sheets to the output tray and displaying an operator warning.

17. In a printing machine having a finisher tray for stacking copy sheets, a method of averting excess finisher capacity comprising the steps of:

sensing the finisher to be near capacity, tracking the number of copy sheets being fed to the finisher tray, monitoring a value stored in memory representing the capacity of the finisher tray, and responsive to tracking the number of copy sheets being fed to the compiler and monitoring the value stored in memory making a determination that the capacity of the finisher tray is being exceeded within an acceptable range.

18. The method of claim 17 including the step of diverting copy sheets from the finisher tray to an alternate tray.

* * * * *